US010597878B1

(12) United States Patent
Smith

(10) Patent No.: US 10,597,878 B1
(45) Date of Patent: Mar. 24, 2020

(54) DECORATIVE GLASS ENCLOSED FLOOR CAVITY FOR RAISED FLOOR CONSTRUCTION

(71) Applicant: Marjean Lenore Smith, Sparks, NV (US)

(72) Inventor: Marjean Lenore Smith, Sparks, NV (US)

(73) Assignee: Marjean Lenore Smith, Sparks, NV (US)

( * ) Notice: Subject to any disclaimer, the term of this patent is extended or adjusted under 35 U.S.C. 154(b) by 0 days.

(21) Appl. No.: 15/932,811

(22) Filed: Apr. 30, 2018

(51) Int. Cl.
*E04F 15/024* (2006.01)
*E04F 15/08* (2006.01)

(52) U.S. Cl.
CPC .. *E04F 15/02494* (2013.01); *E04F 15/02458* (2013.01); *E04F 15/082* (2013.01)

(58) Field of Classification Search
CPC ..... E04F 15/08; E04F 15/082; E04F 15/085; E04F 15/087; E04F 2201/047
USPC ..... 47/29.1, 29.2, 29.3, 29.4; 52/220.1–220.3, 306, DIG. 17
See application file for complete search history.

(56) References Cited

U.S. PATENT DOCUMENTS 312,269 A * 2/1885 Higley ..... 362/153
D238,133 S * 12/1975 Uebele ..... D6/661
4,185,407 A * 1/1980 Lamb ..... G02B 27/024 40/367
5,066,078 A * 11/1991 Wurst ..... A47B 13/12 312/114
5,390,090 A * 2/1995 Nau ..... F21S 8/022 362/145
2012/0297713 A1* 11/2012 Geith ..... A63C 19/065 52/306

* cited by examiner

*Primary Examiner* — William V Gilbert

(57) ABSTRACT

This decorative glass enclosed floor cavity is a new innovation in flooring. It is designed to give flair, special lighting effects or mood to a raised floor room. There is no benefit other than an aesthetic quality given to a room. The strip lights with dimmer give a special mood and the planter boxes filled with artificial plants in the bottom of the cavity give beauty and originality to its form. This decorative floor cavity has a specified size and shape according to the size of the raised floor in which it is built and is constructed with 4×4 posts attached to the finished floor of the cavity with post bases and an asymmetrical grid formed with 2×4s attached to 4×4 posts with hex bolts, deck screws and reinforced L brackets for support of a ⅜" regular or non-slip glass overlay which covers the entire cavity to expose lighting and artificial plants inside cavity. Hand grip slots are cut in end 2×4s to aid in removal of glass for cleaning and to change light bulbs. ⅜" raised floor finish flooring butts up against ⅜" glass overlay to form a level trimmed finished floor. This decorative glass cavity can be built with lights or plants only in the interior with reduced depth of cavity and reduced raised floor level. Can also be built as wall borders. Built with metal or chrome, it is perfect for modern designed structures.

1 Claim, 1 Drawing Sheet

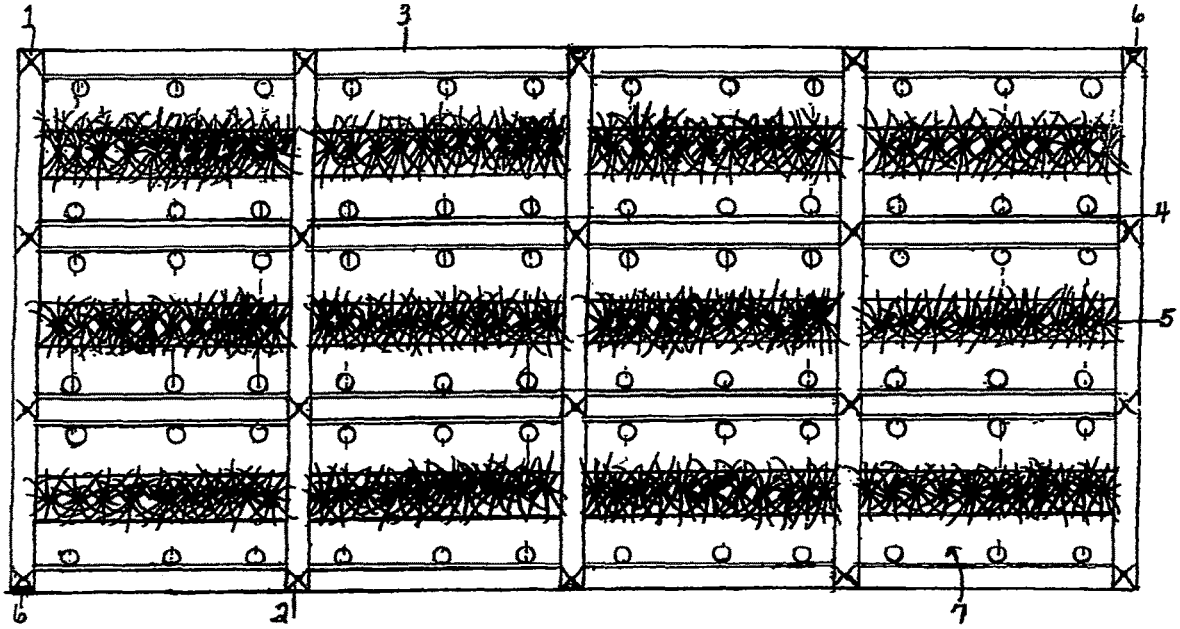
1
3
6
4
5
6
2
7

DECORATIVE GLASS ENCLOSED FLOOR CAVITY FOR RAISED FLOOR CONSTRUCTION

BRIEF DESCRIPTION

This invention is for a decorative glass enclosed floor cavity with strip lights and planter boxes filled with artificial plants inside the cavity, built in raised floor construction. This design is purely aesthetic and gives light, beauty and originality to a raised floor room.

FIELD OF THE INVENTION

The present invention relates to a glass floor and is built in a partial section or partial sections of a raised floor as a decorative cavity with a glass overlay that covers the entire cavity and strip lighting and planter boxes with artificial plants inside the cavity giving an aesthetic quality to a room. This design is for a partial section of glass flooring or multiple sections creating a larger glass floor.

BACKGROUND OF THE INVENTION

There is no background of this invention as it has never been introduced before. This is an original concept for a decorative glass enclosed floor cavity built in a raised floor with strip lights and artificial plants inside the cavity. There is no basic purpose other than giving an aesthetic quality to a room. The lights give flair or mood to a raised floor room and the plants and basic construction add beauty and originality to its form.

BRIEF SUMMARY

This decorative floor cavity is a new innovation in flooring and is designed to give flair, special lighting effects or mood to a raised floor room. The lights and plants inside the cavity give beauty and originality to the room. This design is for a partial section or sections of a raised floor, made up of a framed, finished cavity or cavities, depending on the size of glass flooring desired, with a ⅜" non-slip or regular glass overlay covering the entire cavity, using an asymmetrical grid, made of 2×4s, attached to 4×4 posts with hex bolts, deck screws and reinforced L brackets for support, with strip lighting attached lengthwise to the 4×4 posts with screws, just under the grid, and planter boxes filled with artificial plants attached to the bottom of the finished cavity with screws. Grip slots are cut in end 2×4s to aid in the removal of the glass for cleaning and to change light bulbs. ⅜" non-slip or regular glass butts up against ⅜" finish wood flooring to form a level finished floor.

This design is purely aesthetic and has no other benefit. The room in which this design is used must have a ceiling height of at least 12 feet and the height of the raised floor and the depth of the cavity are determined by the contents of the cavity. Can be built with lights or plants only or lights and plants with varying raised floor levels and cavity depth. When using lights or plants only, raised floor level and cavity depth are reduced by 2 feet.

This glass floor design can also be built with metal or chrome for modern design.

BRIEF DESCRIPTION OF THE DRAWING

Overhead Perspective

FIG. 1 is a top view of the present invention.

LIST OF REFERENCE CHARACTERS (1-*x*) 4×4 posts with counter sunk 5"×½" hex bolts on center to attach 6 foot 2×4s.

(2) 5 widthwise 6 foot 2×4s, with 2'7 perpendicular gap between rows, attached to 4×4 posts with 5"×½" hex bolts counter sunk in center.

(3) 16 lengthwise sections of 2×4s, 2'7" long attached to 4×4 posts with deck screws and reinforced L brackets, to butt up against 6 foot 2×4s, with 1'6⅔" perpendicular gap between rows, forming the asymmetrical grid.

(4) 12 foot strip lighting attached lengthwise under grid to both sides of 4×4 posts.

(5) 12'×7"×9" planter boxes attached to finished floor of cavity with screws. 2'4" artificial plants inside planter boxes.

(6) 3"×1¼"×1¼" hand grip slots to aid in removal of glass overlay.

(7) ⅜" regular or non-slip glass overlay to cover entire cavity.

DETAILED DESCRIPTION

Start with a framed plywood cavity built like miniature walls in a raised floor to specifications on size. I've used a 12'⅜"×6'⅜"×4' 2⅜" unfinished cavity for my patent with a raised floor level of 4'2⅜". Framed cavity must measure 12'×6'×4'2" exactly after being finished with ⅜" wood flooring, the same as used for the finished raised floor, before the next steps of the assembly process. 4 feet for 4×4 post height, 2 inches for grid height, ⅜ inches for cavity wood finish flooring equals 4'2⅜" for cavity height. 12'×6'×4'2" finished cavity measurements. ⅜" wood finish flooring on bottom of cavity raises the height of cavity to 4'2⅜" to match raised sub-floor level.

Attach twenty 4×4 posts 4 feet high, minus the height of post base, if any, placed at the perimeter of and throughout cavity lengthwise every 2'7" and widthwise every 1'6⅔" to form 4 parallel rows lengthwise and 5 parallel rows widthwise, attached to structural finished floor of the cavity with black or brown post bases. (1-*x*) Perimeter posts must be attached flush with finished cavity wall. Posts must be 4 feet in height minus the height of the post base. For example: if post base height off the floor of the finished cavity is 1 inch, take post base height off of 4×4 posts to compensate. Height of 4×4 posts would be 3'11" with 1 inch height of post base.

Asymmetrical grid built with 2×4s 4" side up, widthwise 5 six foot full length 2×4s with 2'7" perpendicular gap between rows. (2) lengthwise sixteen measured sections of 2×4s, 2'7" long with 1'6⅔" perpendicular gap between rows. (3) to butt up against 6 foot full length 2×4s, connected on each side with deck screws and reinforced L brackets for added support. Full length 2×4s must run widthwise so that L bracket placement does not interfere with attached lengthwise lighting strips. (4) Six foot 2×4s attached in center with 5"×½" hex bolts (1-*x*) counter sunk with wood filler or wooden dowels to conceal. At opposite corners of widthwise end 2×4s, cut a hand grip slot 3"×1¼"×1¼" to aid in removal of glass overlay for cleaning and to change bulbs. (6) This grid is not built perfectly symmetrical so that there is more space for glass to emphasize contents of the cavity. The asymmetrical grid also adds design to the floor.

All wood posts and grid must be sanded and stained to match wood finish flooring of raised floor and cavity lined with the same finish flooring must be trimmed out. All 4×4 posts must be exposed so as to be able to attach strip lighting. Post bases must be black or brown to match the interior of the cavity.

Six 12 foot lighting strips, running just under grid, attached lengthwise, one on each side of 4×4 posts (4), with wiring running to one side and under raised sub-floor to wall switch with dimmer. Total strips of lights six. Use clear round bulbs.

Planter boxes (metal or wood to match cavity). Length 12', width 7", height 9", centered in lengthwise space and attached to finished cavity floor with screws. Fill with artificial silk plants or silk plants and flowers. Height of plants must not exceed 2'4" so as to avoid touching lights. (5)

12'×6'×⅜" non-slip or regular glass to cover entire cavity, laid upon asymmetrical grid. (7) ⅜" raised floor finish wood flooring to butt up against ⅜" glass overlay to form level finished floor. Removable wooden trim where glass meets flooring. Glass must be removable for cleaning and to change light bulbs.

This decorative cavity can also be built with lights or plants only. Cavity depth and raised sub-floor level would be 2' 2⅜". 12'×6'×2'2" finished cavity dimensions. ⅜" finish flooring on bottom of cavity raises the height to 2' 2⅜" to match raised sub-floor level. Use 4×4 posts measured 2 feet in height, minus post base height, if any. Use the same basic plan as with lights and plants, just a reduced raised sub-floor level and reduced 4×4 post height. When using lights only, a lazer light pro-Jector can be attached to the bottom of the cavity in the center, for an additional lighting effect, (wiring running under cavity finish flooring to wall switch). Can also be built as wall borders.

This decorative floor cavity can also be built with metal or chrome for modern design. Can be built in new or existing structures.

Although a particular embodiment of the design has been disclosed in detail for illustrative purposes it will be recognized that variations or modifications of the disclosed decorative cavity flooring, including the size, shape and the arrangement and type of building materials, be within the scope of the present design.

The invention claimed is:

1. A decorative glass flooring, comprising:

a cavity formed by a structure made of plywood, said cavity being dimensioned 12'⅜"×6'⅜"×4'2⅜", a plurality of 2"×4" boards placed within said cavity to define an asymmetrical grid of twelve cells, each said cell being substantially rectangular; said cavity having a total of twenty 4"×4" posts, fourteen of said posts being placed about a perimeter of said cavity and six of said posts placed within said cavity at a juncture of four said cells, a respective said board being attached to a respective said post against which said respective said board abuts with an L-bracket, said boards having a slot dimensioned 3"×1¼"×1¼";

a removable glass overlay placed on an upper surface of said cavity, said slots being positioned and configured to assist in removing said removable glass overlay;

six lighting strips, each said strip measuring 12' in length, each said strip being placed under a lower surface of said cavity and extending a length of said cavity, said strips being spaced across a width of said cavity, said strips configured to illuminate said cells;

a planter box placed within each cell, each said planter box having artificial plants contained therein; a finished floor being substantially planar to said removable glass overlay, and removable trim placed between said finished floor and said glass overlay.

* * * * *